US011183201B2

(12) United States Patent
Angland

(10) Patent No.: US 11,183,201 B2
(45) Date of Patent: Nov. 23, 2021

(54) SYSTEM AND METHOD FOR TRANSFERRING A VOICE FROM ONE BODY OF RECORDINGS TO OTHER RECORDINGS

(71) Applicant: John Alexander Angland, New York, NY (US)

(72) Inventor: John Alexander Angland, New York, NY (US)

( * ) Notice: Subject to any disclaimer, the term of this patent is extended or adjusted under 35 U.S.C. 154(b) by 0 days.

(21) Appl. No.: 15/929,597

(22) Filed: May 12, 2020

(65) Prior Publication Data

US 2020/0388295 A1 Dec. 10, 2020

Related U.S. Application Data

(60) Provisional application No. 62/859,343, filed on Jun. 10, 2019.

(51) Int. Cl.
*G10L 21/003* (2013.01)
*G10L 21/013* (2013.01)

(52) U.S. Cl.
CPC ..... *G10L 21/013* (2013.01); *G10L 21/003* (2013.01); *G10L 2021/0135* (2013.01)

(58) Field of Classification Search
CPC ..... G10L 21/003; G10L 21/013; G10L 2021/0135
See application file for complete search history.

(56) References Cited

U.S. PATENT DOCUMENTS

| | | | | |
|---|---|---|---|---|
| 4,392,409 | A | 7/1983 | Coad, Jr. et al. | |
| 4,577,343 | A | 3/1986 | Oura | |
| 5,864,814 | A | 1/1999 | Yamazaki | |
| 7,424,430 | B2 | 9/2008 | Kawahara et al. | |
| 7,483,832 | B2 | 1/2009 | Tischer | |
| 7,610,205 | B2 | 10/2009 | Crockett | |
| 7,940,897 | B2 | 5/2011 | Khor et al. | |
| 8,078,470 | B2 | 12/2011 | Levanon et al. | |
| 8,204,747 | B2 | 6/2012 | Kato et al. | |
| 8,676,574 | B2 | 3/2014 | Kalinli | |
| 8,831,762 | B2 | 9/2014 | Abe et al. | |
| 9,001,976 | B2 | 4/2015 | Arrowood et al. | |
| 9,330,720 | B2 | 5/2016 | Lee | |
| 10,970,629 | B1 * | 4/2021 | Dirac | G06N 3/08 |
| 2009/0132242 | A1 | 5/2009 | Wang et al. | |
| 2009/0171657 | A1 * | 7/2009 | Tian | G10L 21/00 704/219 |
| 2011/0081024 | A1 * | 4/2011 | Soulodre | H04S 7/30 381/17 |
| 2012/0253794 | A1 * | 10/2012 | Chun | G10L 21/003 704/201 |
| 2013/0070911 | A1 | 3/2013 | O'Sullivan | |
| 2018/0061439 | A1 * | 3/2018 | Diamos | G10L 15/063 |
| 2018/0174575 | A1 * | 6/2018 | Bengio | G10L 15/02 |
| 2019/0043508 | A1 * | 2/2019 | Sak | G10L 17/18 |
| 2019/0251952 | A1 * | 8/2019 | Arik | G10L 13/033 |
| 2019/0303465 | A1 * | 10/2019 | Shanmugamani | G06F 16/2237 |

(Continued)

FOREIGN PATENT DOCUMENTS

CN 109767752 A * 5/2019 ..... G01L 13/02

*Primary Examiner* — Daniel C Washburn
*Assistant Examiner* — Oluwadamilola M Ogunbiyi
(74) *Attorney, Agent, or Firm* — Dunlap Bennett & Ludwig, PLLC

(57) ABSTRACT

A system and method for transferring a voice from one body of recordings to other recordings.

10 Claims, 3 Drawing Sheets

(56) References Cited

U.S. PATENT DOCUMENTS

| | | | | |
|---|---|---|---|---|
| 2020/0388287 | A1* | 12/2020 | Anushiravani | G10L 17/26 |
| 2021/0005176 | A1* | 1/2021 | Blaauw | G10L 13/0335 |
| 2021/0050020 | A1* | 2/2021 | Li | G10L 17/02 |
| 2021/0082444 | A1* | 3/2021 | Fejgin | G10L 19/00 |

* cited by examiner

SYSTEM AND METHOD FOR TRANSFERRING A VOICE FROM ONE BODY OF RECORDINGS TO OTHER RECORDINGS

CROSS-REFERENCE TO RELATED APPLICATION

This application claims the benefit of priority of U.S. provisional application No. 62/859,343, filed 10 Jun. 2019, the contents of which are herein incorporated by reference.

BACKGROUND OF THE INVENTION

The present invention relates to a system and method for transferring a voice from one body of recordings to other recordings.

SUMMARY OF THE INVENTION

In one aspect of the present invention, method of converting an audio waveform to a chosen voice includes the following: obtaining a first set of rules that define an audio information real-valued matrix as a function of an audio waveform converted to a respective frequency domain; obtaining a second set of rules that define an encoded matrix as a lossy function of the audio information; obtaining a third set of rules that define a decoded information real-valued matrix as the output of a biased function that converts the encoded matrix to the frequency domain; obtaining a fourth set of rules that converts a frequency domain matrix back into the time domain; applying the first, second and third sets of rules for several audio samples of the chosen voice; applying a loss function for measuring a difference value between the outputs of the first and third sets of rules for several audio samples of the chosen voice; reducing the difference between the outputs of the first and third set of rules as measured by the loss function, by applying an optimization algorithm; and applying the first, second, third and fourth sets of rules to an audio sample in a different voice.

In another aspect of the present invention, a method of converting an audio waveform to a chosen voice includes the following: obtaining a first set of rules that define an audio information matrix as a function an audio waveform converted to a respective frequency domain; obtaining a second set of rules that define an encoded matrix as a lossy function of the audio information, wherein the lossy algorithm is configured to preserve language and cadence of the original recording; obtaining a third set of rules that define a decoded information matrix as the output of a biased function converting the encoded matrix to the frequency domain, wherein the first and third set of rules are configured to produce equal-sized matrices, respectively; applying a loss function for measuring a difference value between the spectra of the respective matrices for one or more variables defining the chosen voice, wherein the one or more variables are initially calibrated evaluating audio data from the chosen speaker against the first, second and third set of rules; evaluating the audio waveform against the first, second and third set of rules; reducing the value of the loss function using an optimization algorithm; and converting the decoded information matrix with reduced difference values into a time domain, wherein the audio waveform is a subject voice recording, wherein each value of the outputs of first and third sets of rules represents the magnitude of a specific frequency in one time frame.

In yet another aspect of the present invention, a method of converting an audio waveform to a chosen voice includes the following: obtaining a first set of rules that define an audio information real-valued matrix as a function of an audio waveform converted to a respective frequency domain; obtaining a second set of rules that define an encoded matrix as a lossy function of the audio information; obtaining a third set of rules that define a decoded information real-valued matrix as the output of a biased function that converts the encoded matrix to the frequency domain; applying a loss function for measuring a difference value between the spectra of the respective matrices for one or more variables defining the chosen voice; reducing the difference between the outputs of the first and third set of rules as measured by the loss function, by applying an optimization algorithm; and converting the decoded information matrix with reduced difference values into a time domain.

In yet another aspect of the present invention, a method of converting an audio waveform to a chosen voice includes the following: obtaining a first set of rules that define an audio information real-valued matrix as a function of an audio waveform converted to a respective frequency domain; obtaining a second set of rules that define an encoded matrix as a lossy function of the audio information; obtaining a third set of rules that define a decoded information real-valued matrix as the output of a biased function that converts the encoded matrix to the frequency domain; applying a loss function for measuring a difference value between the spectra of the respective matrices for one or more variables defining the chosen voice; reducing the difference between the outputs of the first and third set of rules as measured by the loss function, by applying an optimization algorithm; and converting the decoded information matrix with reduced difference values into a time domain.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a system and method for transferring a voice from one body of recordings to other recordings.

Figure 1:
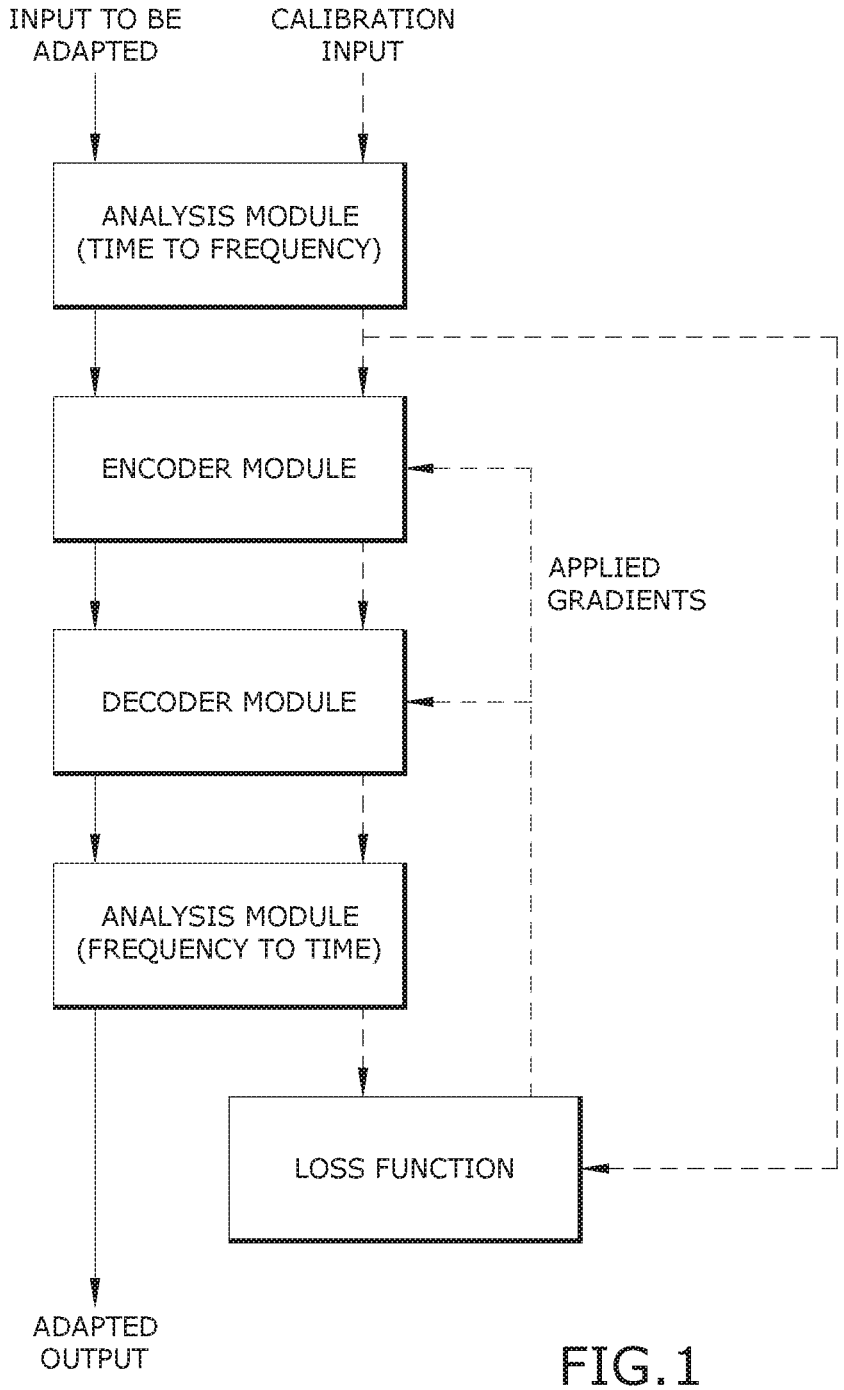
FIG. 1 is a flow chart of an exemplary embodiment of the present invention.
Figure 2:
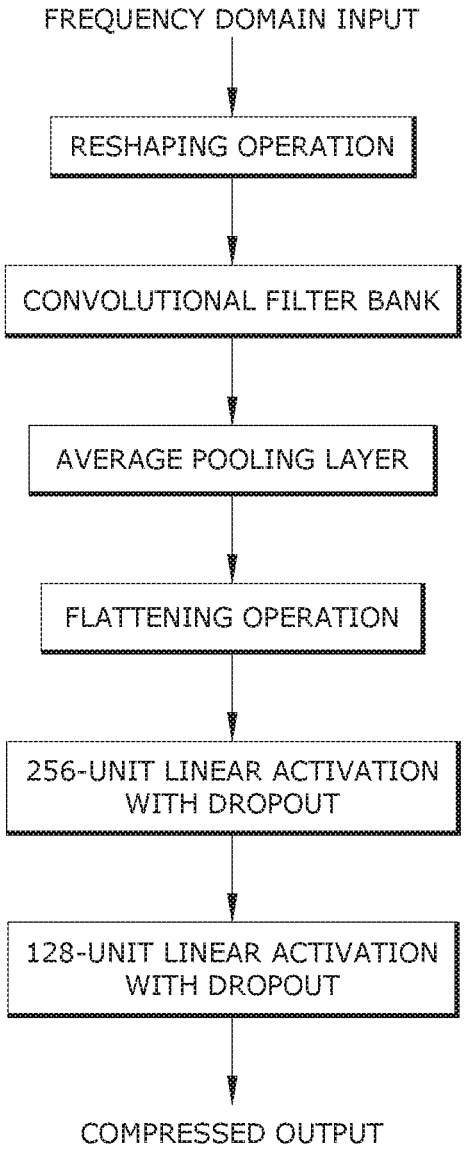
FIG. 2 is a schematic view of an exemplary embodiment of the present invention.
Figure 3:
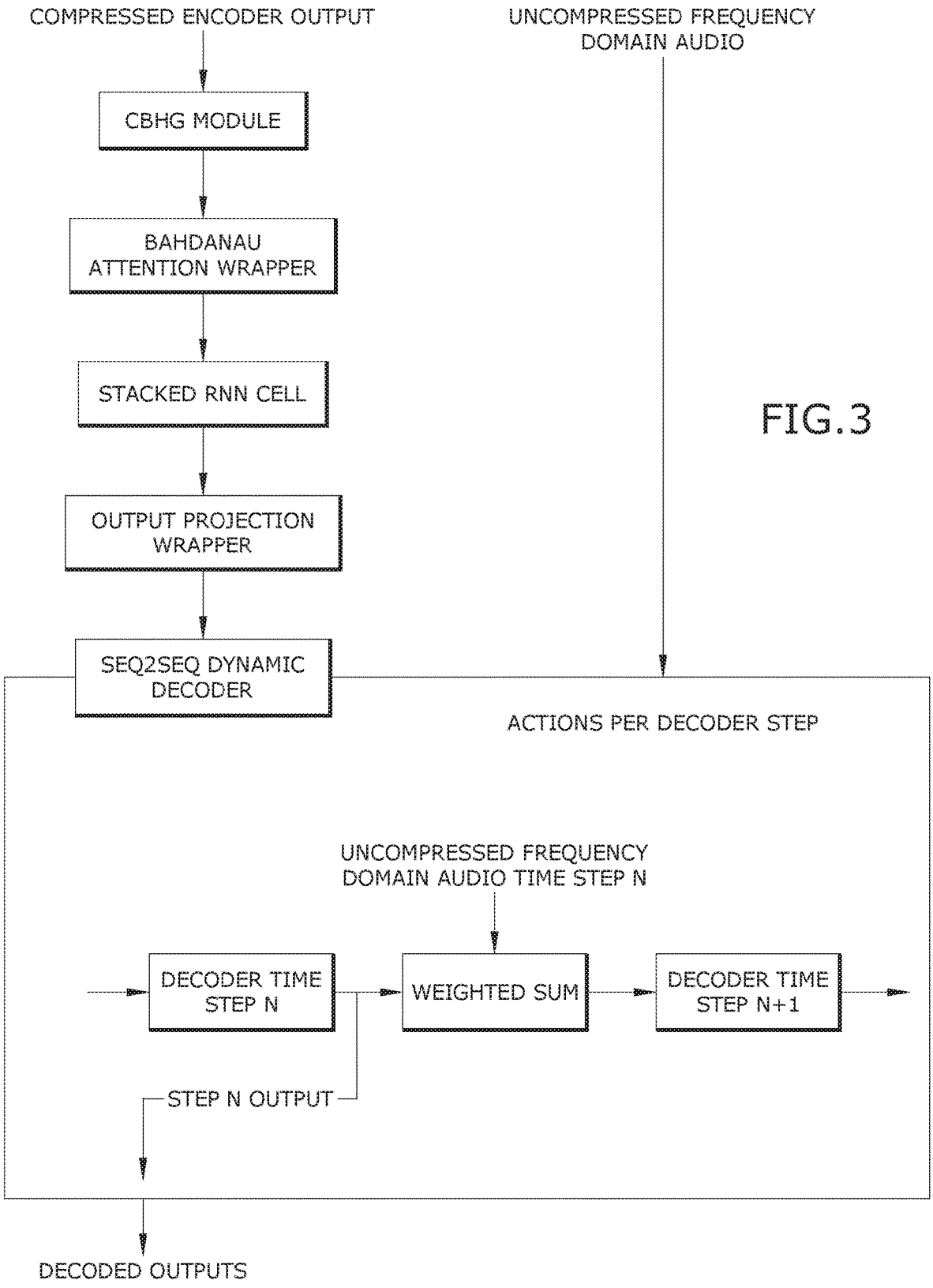
FIG. 3 is a schematic view of an exemplary embodiment of the present invention, illustrating the reservoir detached.

Referring to FIGS. 1 through 3, the present invention may include at least one computer with a user interface. The computer may include at least one processing unit coupled to a form of memory. The computer may include, but not limited to, a microprocessor, a server, a desktop, laptop, and smart device, such as, a tablet and smart phone. The computer includes a program product including a machine-readable program code for causing, when executed, the computer to perform steps. The program product may include software which may either be loaded onto the computer or accessed by the computer. The loaded software may include an application on a smart device. The software may be accessed by the computer using a web browser. The computer may access the software via the web browser using the internet, extranet, intranet, host server, internet cloud and the like. The user interface includes hardware, software, or both providing one or more interfaces for communication between the computing devices and a user. As an example and not by way of limitation, a user interface may include a keyboard, keypad, microphone, monitor, mouse, printer, scanner, speaker, still camera, stylus, touch-screen, trackball, video camera, another suitable device or a combination of two or more of these.

The ordered combination of various ad hoc and automated tasks in the presently disclosed platform necessarily achieve technological improvements through the specific processes described more in detail below. In addition, the unconventional and unique aspects of these specific automation processes represent a sharp contrast to merely providing a well-known or routine environment for performing a manual or mental task.

The present invention is a system and method for transferring a voice from one body of recordings to other recordings. The present invention is calibrated before use using a body of digital audio voice recordings from a chosen speaker, and once calibrated can be used to produce an adapted version of any voice recording such that the speaker in the adapted version appears to be the chosen speaker, and such that the language and cadence from that recording is not changed. The present invention works by first applying a lossy compression function that is well suited to preserving language and cadence but not timbre, and then applying a biased decompression function that substitutes in timbre information from the voice that was used for calibration.

Referring now to the Figures, the present invention is a computer program run by a computing system. The computer program includes an analysis module for converting audio information from the time domain to the frequency domain and back, an encoder used to convert frequency domain audio information into a compressed form, a decoder for decompressing compressed audio information back into the frequency domain, and a loss function for measuring the difference between two audio spectra. The encoder, decoder and loss function modules are implemented using a mathematical framework that makes accessible the partial derivative of any value computed therein with respect to any variable therein, and that can update those variables in such a way that reduces a chosen computed value using the Adam Optimization algorithm. Examples of such frameworks include Theano, Keras and Tensorflow.

The present disclosure is to be considered as an exemplification of the present invention and is not intended to limit the present invention to the specific embodiments illustrated by the Figures or description below. This exemplification assumes that audio input for both adaptation and calibration is provided at a sampling rate of 22050 Hz, where each sample is a floating-point value between-1.0 and 1.0.

The analysis module performs two functions, firstly the conversion of an audio waveform into a real valued frequency domain matrix wherein each value represents the magnitude of a specific frequency in one time frame, and secondly the conversion of such matrices back into the time domain. To convert from the time domain to the frequency domain, the analysis module first takes the 0.97 pre-emphasis improvement of the audio input; then, takes the mel spectrogram of the result, with a recommended frame length of 50 milliseconds, a Hann window, an inter-frame step of 12.5 milliseconds, and 80 log spaced frequency outputs, with a recommended frequency range of 20 Hz to 20000 Hz; then takes the real absolute value of the complex result; then applies the scaling function $f(x)=\text{clip}((\log_{10}(\max(x, 10\hat{}-5))+4)/5, 0, 1)$, where $\text{clip}(a,b,c)=\min(\max(a,b),c)$. To perform the frequency to time domain conversion, the module first applies the function $f(x)=10\hat{}(5*\text{clip}(x,0,1)-4)$ to each scalar value within the frequency domain input; then adds synthetic phase information via the Griffin-Lim algorithm; then converts back to the time domain by applying the inverse of the mel spectrogram transformation used in the frequency to time step; and finally applies the inverse of the pre-emphasis function used in the frequency to time step.

Referring to FIGS. 2 and 3, the encoder may convert frequency domain audio information into a compressed form by way of a lossy algorithm. In the suggested configuration, the input to this module has three dimensions equal to the batch size, the frame count and the frequency count. The module is suggested to comprise a neural network of the following layers in the order specified:

1) A reshaping operation that appends a single dimension of size 1 to the shape of the input tensor.
2) A 2-d convolutional filter bank with 16 filters, where the nth filter has n output channels and filter size 1×n, with the filters being oriented such that the first dimension encompasses a single time step and the second dimension spans n frequencies.
3) A average pooling layer with pool size 4×4 and stride length 4×4.
4) A flattening layer that collapses the last two dimensions of the prior layer into a single dimension.
5) A densely connected layer with 256 output units and linear activation. In training, dropout should be applied to this layer with p=0.5.
6) A second densely connected layer with 128 output units and linear activation. In training, dropout with p=0.5 should be applied to this layer.

The decoder converts compressed data from the encoder back to the frequency domain. This is principally handled by a recurrent neural network consisting of several layers. This means that the matrix output of the prior step must be converted to the shape of a recurrent neural network. In this new representation, every column in that matrix representing a single time step will be represented by a single recurrent step that has both a hidden state vector and an output vector. The initial conversion will be handled by a CBHG module with an initial conv-k-128-ReLU Conv1D bank with K=16, a max pooling width of 2 and stride 1, conv-3-128-ReLU and conv-3-128-Linear projections, a 4 layer FC-128-ReLU highway net, and a 128 unit Birectional GRU cell. The output of that module is a recurrent neural network with 128 hidden units and 128 output units. This is the first recurrent layer, and it is followed by several successive recurrent layers, which are applied in the following order:

1) A Bandanau Attention Wrapper using a single GRU cell with depth 256, and configured to concatenate the attention to the output at every step.

2) A multiRNNCell consisting of three layers; a 256-unit OutputProjectionWrapper, and two 256-unit GRU cells.

3) Another OutputProjectionWrapper with 256 units.

The output of this recurrent neural network is converted back into a matrix using a seq2seq dynamic decoder with an initial state of all zeros. The input of this decoder in training will be zeros for its first output, and for all subsequent outputs the input will be its previous output. In production, the input for its first output will likewise be zero. For all subsequent production outputs, the input will be a weighted sum of the prior output and the corresponding time frame from the frequency domain output of the analysis module. In our recommended configuration, the weight of each prior output will be 0.8 and the weight of the analysis frame will be 0.2. Finally, the output of the seq2seq dynamic decoder is be fed through a single hidden layer with a number of output units equal the number of frequencies expected by the analysis module.

The loss function measures the difference between two equal-sized matrices representing frequency-domain audio information. Given matrices a and b, this function returns the average of the absolute values of each element of a-b.

Before use, the present invention is calibrated using audio data from a chosen speaker. Two hours of audio should be sufficient. The calibration audio should be split into segments no more than 8 seconds in length, and grouped into several batches with a suggested size of 32 segments per batch, which should be converted into the frequency domain using the analysis module, compressed using the encoder, and decompressed using the decoder. The variables within the encoder and decoder should be updated with each batch so as to minimize the value of the loss function when applied to measure the difference between the initial output of the analysis module and the output of the decoder. This update should be performed using the Adam Optimization algorithm with $\alpha=0.001$, $\beta_1=0.9$, $\beta2=0.999$, and $\varepsilon=10\hat{}-8$. This process should be repeated with randomly sampled batches for at least 10,000 steps, or until the loss function consistently returns values below 0.09. Once this is complete, audio recordings can be adapted to sound like the chosen speaker by applying the following steps, as illustrated in the FIG. 1:

1) Use the analysis module to convert the audio to the frequency domain.

2) Apply the encoder module to the result of step 1.

3) Apply the decoder module to the result of step 2.

4) Use the analysis module to convert the result of step 3 back to the time domain.

There are several aspects of the invention that could be modified. The analysis module could be changed to have a different window type, frame length, inter-frame step or different output frequencies. The encoder module and decoder module both comprise neural networks each consisting of many layers. The layers suggested could be altered by having their activation functions or suggested output unit counts altered. Each layer contributes in a small way to the final result, so adding or removing some layers could result in only minor changes to any adapted recordings. The loss function could be altered by assigning different weights to different frequencies. A different optimization algorithm could be used in place of Adam Optimization, or the parameters used for Adam Optimization could be changed.

The present invention could potentially be applied to computer-aided, audio-to-audio language translation, where the speaker of one language would like the audio output of his translation program to resemble his own voice as closely as possible. The present invention can be used to produce an entertainment product whereby a user adapts recordings of their own voice to sound like those of other people. The present invention could be deployed in the form of an application or website.

In certain embodiments, the computing device may execute on any suitable operating system such as IBM's zSeries/Operating System (z/OS), MS-DOS, PC-DOS, MAC-OS, WINDOWS, UNIX, OpenVMS, an operating system based on LINUX, or any other appropriate operating system, including future operating systems.

The processor includes hardware for executing instructions, such as those making up a computer program. The memory is for storing instructions such as computer program(s) for the processor to execute, or data for processor to operate on. The memory may include an HDD, a floppy disk drive, flash memory, an optical disc, a magneto-optical disc, magnetic tape, a Universal Serial Bus (USB) drive, a solid-state drive (SSD), or a combination of two or more of these. The memory may include removable or non-removable (or fixed) media, where appropriate. The memory may be internal or external to the computing device, where appropriate. In particular embodiments, the memory is non-volatile, solid-state memory.

It should be understood, of course, that the foregoing relates to exemplary embodiments of the invention and that modifications may be made without departing from the spirit and scope of the invention as set forth in the following claims.

What is claimed is:

1. A method of converting an audio waveform to a chosen voice, comprising:

obtaining a first set of rules that define an audio information real-valued matrix as a function of an audio waveform converted to a respective frequency domain;

obtaining a second set of rules that define an encoded matrix as a lossy function of the audio information;

obtaining a third set of rules that define a decoded information real-valued matrix as the output of a biased function that converts the encoded matrix to the frequency domain;

obtaining a fourth set of rules that converts a frequency domain matrix back into the time domain; applying the first, second and third sets of rules for several audio samples of the chosen voice;

applying a loss function for measuring a difference value between the outputs of the first and third sets of rules for several audio samples of the chosen voice;

reducing the difference between the outputs of the first and third set of rules as measured by the loss function, by applying an optimization algorithm; and applying the first, second, third and fourth sets of rules to an audio sample in a different voice.

2. The method of claim 1, wherein the audio waveform is a subject voice recording.

3. The method of claim 1, wherein the first and third set of rules are configured to produce equal-sized matrices, respectively.

4. The method of claim 1, wherein the respective matrices are real-valued matrices.

5. The method of claim 1, wherein the one or more variables are initially calibrated evaluating audio data from the chosen speaker against the first, second and third set of rules.

6. The method of claim 5, subsequently evaluating the audio waveform against the first, second and third set of rules.

7. The method of claim 6, wherein the lossy algorithm is configured to preserve language and cadence of the chosen voice.

8. A method of converting an audio waveform to a chosen voice, comprising:

obtaining a first set of rules that define an audio information matrix as a function of an audio waveform converted to a respective frequency domain;

obtaining a second set of rules that define an encoded matrix as a lossy function of the audio information, wherein the lossy algorithm is configured to preserve language and cadence of the original recording;

obtaining a third set of rules that define a decoded information matrix as the output of a biased function converting the encoded matrix to the frequency domain, wherein the first and third set of rules are configured to produce equal-sized matrices, respectively;

applying a loss function for measuring a difference value between the spectra of the respective matrices for one or more variables defining the chosen voice, wherein the one or more variables are initially calibrated evaluating audio data from the chosen speaker against the first, second and third set of rules;

evaluating the audio waveform against the first, second and third set of rules;

reducing the value of the loss function using an optimization algorithm; and converting the decoded information matrix with reduced difference values into a time domain.

9. The method of claim 8, wherein the audio waveform is a subject voice recording.

10. The method of claim 8, wherein each value of the outputs of the first and third sets of rules represents the magnitude of a specific frequency in one time frame.

* * * * *